US010182632B2

(12) United States Patent
Kearsley

(10) Patent No.: US 10,182,632 B2
(45) Date of Patent: Jan. 22, 2019

(54) SYSTEM, METHOD AND APPARATUS FOR SECURING AND PROTECTING KEYS AND PERSONAL ACCESSORIES

(71) Applicant: Karen E. Kearsley, Waltham, MA (US)

(72) Inventor: Karen E. Kearsley, Waltham, MA (US)

( * ) Notice: Subject to any disclaimer, the term of this patent is extended or adjusted under 35 U.S.C. 154(b) by 0 days.

(21) Appl. No.: 15/341,317

(22) Filed: Nov. 2, 2016

(65) Prior Publication Data

US 2017/0135455 A1 May 18, 2017

Related U.S. Application Data

(60) Provisional application No. 62/255,494, filed on Nov. 15, 2016, provisional application No. 62/258,478, filed on Nov. 22, 2015.

(51) Int. Cl.
*A45C 11/32* (2006.01)

(52) U.S. Cl.
CPC ..... *A45C 11/321* (2013.01); *A45C 2011/322* (2013.01)

(58) Field of Classification Search
CPC ..... A45C 11/32; A45C 11/321; A45C 11/322; A45C 11/329; A45C 13/10; A45C 13/30; A45C 13/26
USPC ..... 206/37–37.8, 38, 38.1, 234–241
See application file for complete search history.

(56) References Cited

U.S. PATENT DOCUMENTS

| | | | | | |
|---|---|---|---|---|---|
| 946,119 | A | | 1/1910 | Field | |
| 1,139,370 | A | * | 5/1915 | Putnam | A45C 11/323 206/37.1 |
| 1,414,798 | A | | 5/1922 | Welcker | |
| 1,509,829 | A | | 9/1924 | Doty | |
| 1,715,348 | A | | 6/1929 | Barbara | |
| 1,721,510 | A | | 7/1929 | Del'Eau | |
| 1,726,569 | A | | 9/1929 | Kasting | |
| 1,766,801 | A | * | 6/1930 | Ragsdale | A45C 11/329 206/37.2 |
| 2,066,033 | A | * | 12/1936 | Dahlgren | A45C 11/323 206/38.1 |
| 2,130,469 | A | * | 9/1938 | Nasser | A45C 11/323 206/37.1 |
| 2,564,382 | A | | 8/1951 | Stawsky | |
| 2,912,030 | A | * | 11/1959 | Stiller | A45C 11/329 206/37.1 |
| 3,007,568 | A | * | 11/1961 | Kurland | A45C 11/325 206/37.1 |

(Continued)

FOREIGN PATENT DOCUMENTS

| | | | | | |
|---|---|---|---|---|---|
| GB | 286785 | A | * | 3/1928 | A45C 11/329 |
| GB | 412623 | A | * | 7/1934 | A45C 11/329 |

*Primary Examiner* — Bryon Gehman
(74) *Attorney, Agent, or Firm* — Grogan, Tuccillo & Vanderleeden LLP

(57) ABSTRACT

An apparatus for securing and protecting small objects includes a shroud having a top opening and a bottom opening, a strap received through the top opening and having a first end and a second end, a mounting mechanism on the first end of the strap, and an object retaining mechanism on the second end of the strap for receiving an object. The shroud is slidable along the strap between a stowed position, where the shroud substantially covers the object, and an access position, where the object is positioned outside the shroud permitting access to the object.

12 Claims, 14 Drawing Sheets

(56) References Cited

U.S. PATENT DOCUMENTS

| | | | | |
|---|---|---|---|---|
| 5,042,649 | A | 8/1991 | McNutt | |
| 6,017,072 | A * | 1/2000 | Grant | A45C 11/32 150/107 |
| 6,435,340 | B1 * | 8/2002 | Bowes, Jr. | A45C 11/32 206/37.1 |
| 2007/0151872 | A1 * | 7/2007 | Vincent | A45C 11/321 206/37.1 |
| 2016/0113365 | A1 * | 4/2016 | Lank | A45C 3/00 383/40 |

* cited by examiner

SYSTEM, METHOD AND APPARATUS FOR SECURING AND PROTECTING KEYS AND PERSONAL ACCESSORIES

CROSS-REFERENCE TO RELATED APPLICATIONS

This application claims the benefit of U.S. Provisional Application Ser. No. 62/255,494, filed on Nov. 15, 2015, and U.S. Provisional Application Ser. No. 62/258,478, filed on Nov. 22, 2015, both of which are herein incorporated by reference in their entireties.

FIELD OF THE INVENTION

The present invention relates generally to personal convenience devices and, more particularly, to a system, method and apparatus for securing and protecting keys and other personal accessories.

BACKGROUND OF THE INVENTION

A common problem that plagues many people is locating frequently used, small accessories and devices, such as keys, key fobs, remotes and the like at times when they are needed. Such items may be commonly misplaced at home, at work, or even lost at the bottom or in one of many pockets in one's pursue due to the small nature of such items and the busy lives that many people lead.

Existing solutions aimed at addressing this problem have involved the use of lanyards, straps and the like which are designed to be worn around the neck and/or can be hung from a backpack, briefcase or purse. Keys, key fobs, and other objects may be coupled to the lanyard or strap, enabling easy access to such objects and minimizing the likelihood of misplacement. These lanyards, with keys or other objects dangling therefrom, however, can swing wildly back and forth as a wearer moves about. Quick and abrupt movements can even cause the lanyard and the objects attached thereto to strike people and objects in close proximity, creating a hazard.

The likelihood of such lanyards and objects they carry striking property or persons is exacerbated where people travel in close proximity, such as is the case with students moving about hallways and accessing lockers arranged tightly side by side. In particular, students lined up shoulder-to-shoulder at their lockers may be struck by a swinging lanyard as one of their neighbors closes his/her locker and abruptly turns away to enter the flow of traffic in the hallway. Such movement can also cause the lanyard and the objects it carries to strike the face of the locker, causing scratching or denting.

In view of the above, there is a need for a system and apparatus for securing and protecting keys and other small objects and accessories that minimizes the likelihood of misplacement while at the same time prevents damage or injury to objects and persons in close proximity.

SUMMARY OF THE INVENTION

It is an object of the present invention to provide an apparatus for securing and protecting keys and other accessories.

It is another object of the present invention to provide an apparatus that is capable of protecting keys and other accessories from inclement weather.

It is another object of the present invention to provide an apparatus that is capable of protecting keys another other accessories, and which prevents such keys and other accessories from rubbing against adjacent materials.

It is another object of the present invention to provide an apparatus for securing and protecting keys and other accessories that enables easy and quick access to such keys or accessories.

It is another object of the present invention to provide an apparatus for securing and protecting keys and other accessories that is aesthetically pleasing.

These and other objects are achieved by the present invention.

According to one embodiment of the present invention, an apparatus for securing and protecting small objects is provided. The apparatus includes a shroud having a top opening and a bottom opening, a strap received through the top opening and having a first end and a second end, a mounting mechanism on the first end of the strap, and an object retaining mechanism on the second end of the strap for receiving an object. The shroud is slidable along the strap between a stowed position, where the shroud substantially covers the object, and an access position, where the object is positioned outside the shroud permitting access to the object. The object may be a key or key fob.

According to another embodiment of the present invention a method for securing and protecting keys and other objects is provided. The method includes the steps of attaching at least one object to a first end of a strap, coupling the strap to a shroud such that the strap is slidably received through an aperture in a top of the shroud, and attaching a second end of the strap to a personal accessory. The shroud is movable towards the first end of the strap to enclose the at least one object within the shroud and is movable towards the second end of the strap to expose the at least one object. The object may be a key or key fob. The personal accessory may be a purse, briefcase, laptop case, or article of clothing.

BRIEF DESCRIPTION OF THE DRAWINGS

The present invention will be better understood from reading the following description of non-limiting embodiments, with reference to the attached drawings, wherein below.

DETAILED DESCRIPTION OF THE PREFERRED EMBODIMENT

Figure 1:
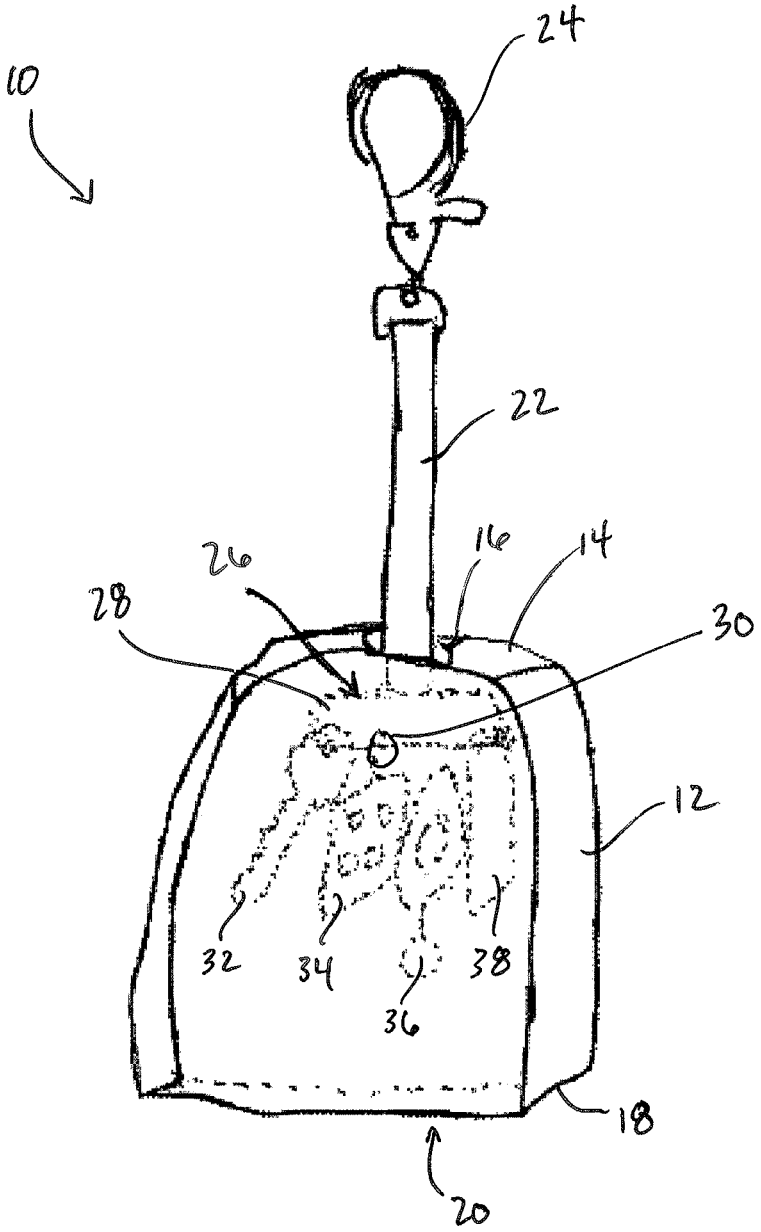
FIG. 1 is a perspective view of an apparatus for securing and protecting keys and other accessories, according to an embodiment of the present invention.
Figure 2:
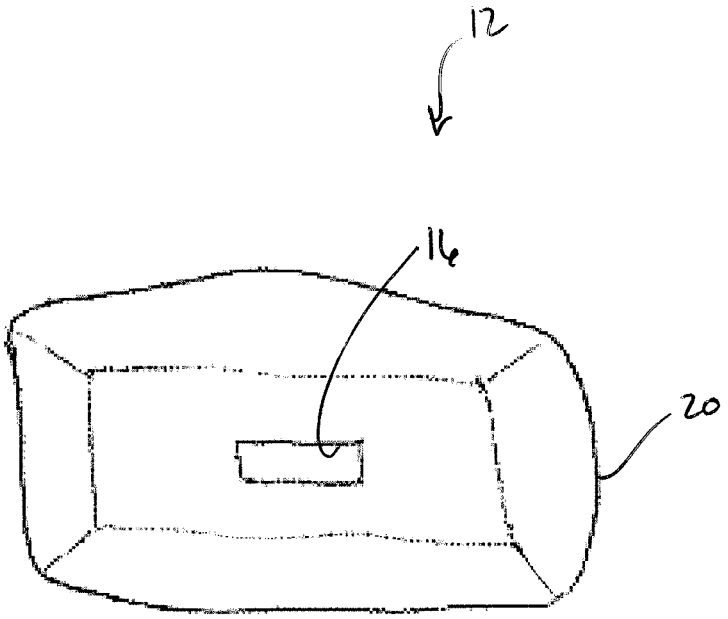
FIG. 2 is a bottom plan view of the apparatus of FIG. 1.

Referring to FIG. 1, the present invention relates to an apparatus 10 for securing and protecting keys and other small accessories or objects. As shown therein, the apparatus 10 includes a shroud 12 having a top end 14 having an aperture or opening 16 formed therein, and a bottom end 18 having an opening 20. In the preferred embodiment, the shroud 12 is generally conical or tapered in shape, having a wider bottom end 18 and a narrower top end 14. In an embodiment, the bottom opening 20 has a greater area than the top opening 16. As best shown in FIG. 2, in an embodiment, the top opening 16 may be formed as a slot.

As further illustrated in FIG. 1, the apparatus 10 further includes a strap or tether 22 that extends through the top opening 16 of the shroud and includes a mounting mechanism in the form of a clasp 24 on one end thereof, and an accessory or object retaining mechanism 26 on an opposite end thereof. While the clasp 24 is illustrated as a swivel lobster-claw type clasp, other types of clasps such as carabiners, trigger snaps, mitten clips, claw clips and the like may also be utilized without departing from the broader aspects of the invention. In an embodiment, the object retaining mechanism 26 may include a hub 28 for receiving one or more split key rings 30 or other clasps for coupling keys 32 and other small objects 34, 36, 38 to the strap 22. In an embodiment, the retaining mechanism 26 may likewise be a lobster claw, carabiner or other type clasp. In certain embodiments, the clasp 24 may be omitted and the strap 22 itself may be configured to tie or otherwise connect to a purse, briefcase or the like, as discussed in detail hereinafter.

In use, a user may attach keys 32, key fobs and other small objects 34, 36, 38 (e.g., mouth guards or mouth-guard cases) to the object retaining mechanism 26 by pulling the strap downward through the top opening 16 until the object retaining mechanism 26 is exposed through the bottom opening 20, and then attaching any desired objects to the retaining mechanism 26. Once the desired objects are secured to the retaining mechanism 26, the user grasps the strap 22 and slides the shroud 12 over the keys 32 and other objects 34, 36, 38. The apparatus 10 may then be attached to a purse, handbag, briefcase or the like utilizing the mounting mechanism 24. Notably, the weight of gravity maintains the shroud 12 in position over the objects.

In this position, the keys 32 and other objects 34, 36, 38 are protected from weather by the shroud 12. In addition, the shroud 12 prevents the keys 32 and objects 34, 36, 38 from scratching or otherwise damaging other objects that may come in contact with the shroud 12. At the same time, however, the keys 32 and other objects 34, 36, 38 are kept close at hand and readily accessible. For example, when a user wishes to access the key 32 or one of the other objects 34, 36, 38, a user may simply reach inside the shroud 12 through the bottom opening 20 and grasp a key 32 or other object coupled to the retaining mechanism 26 (or even the strap 22) with one hand, while simultaneously pulling upwards on the shroud 12 with the other. This causes the shroud 12 to slide upwards along the strap 22, exposing the keys 32 and other objects 34, 36, 38 when needed.

In an embodiment, the strap 22 may be formed as a retractable cord, allowing the keys to be extended from the shroud when needed to unlock a lock, and automatically retracting into the shroud 12 when the key is released. In an embodiment the strap 22 may be formed form an elastic material.

Figure 3:
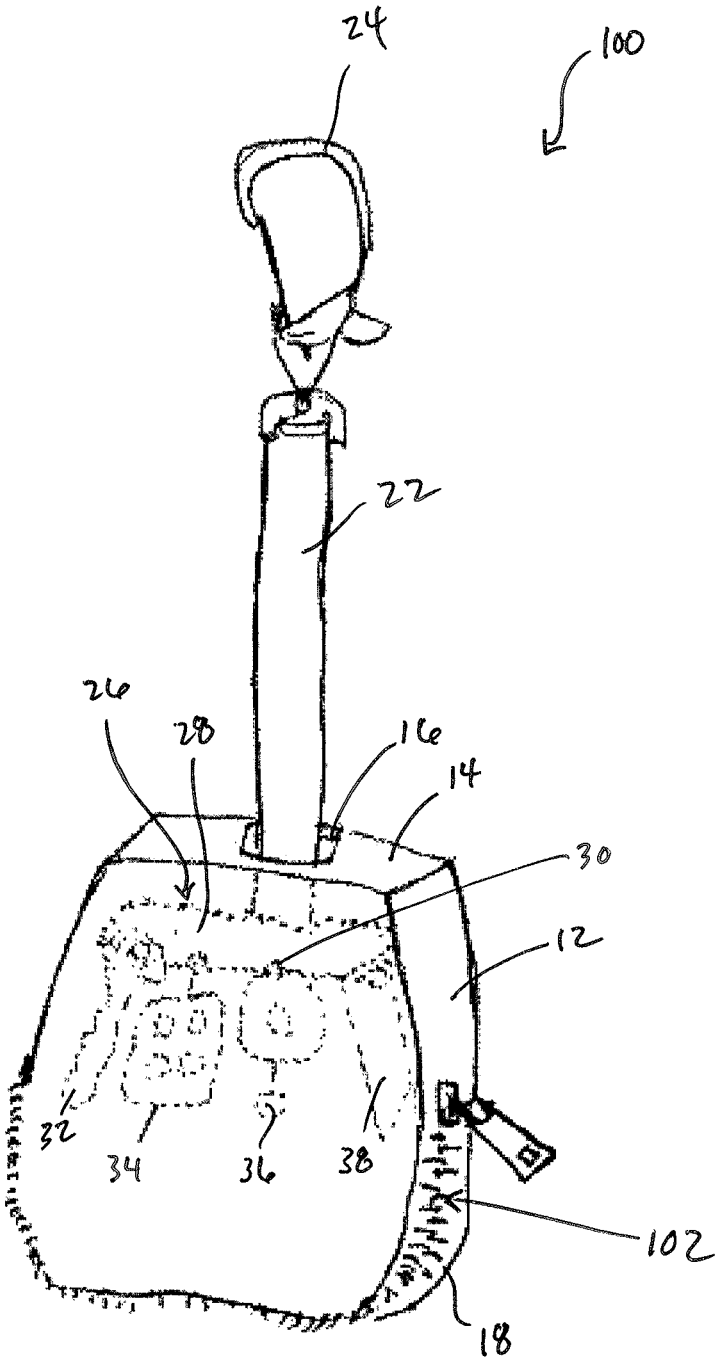
FIG. 3 is a perspective view of an apparatus for securing and protecting keys and other accessories, according to another embodiment of the present invention.

With reference to FIG. 3, an apparatus 100 for securing and protecting keys and other small accessories or objects according to another embodiment of the invention is illustrated. The apparatus 100 is substantially similar to apparatus 10 described above in connection with FIGS. 1 and 2, where like reference numerals designate like parts. Rather than having an open bottom end 18, however, the bottom of the shroud 12 may be configured with a zipper 102 so that the bottom may be selectively opened and closed, providing for an enhanced level of security and protection for the keys and other objects within the shroud 12. While FIG. 3 illustrates a zipper 102, other closing means such as snaps, Velcro, and the like may also be utilized to selectively close the opening, without departing from the broader aspects of the present invention.

It is contemplated that the shroud 12 may take any shape, size and/or form and may be constructed to provide a pleasing appearance. For example, the shroud 12 may be formed from materials configured to match personal accessories such as purses, backpacks, briefcases laptop cases and the like, to which the apparatus 10 is configured to be attached. In an embodiment, the shroud may be formed from materials including, but not limited to, leather, cotton, vinyl, plastic and wood. Moreover, the shroud 12 may include, for example, a picture holder, decorative flaps, snaps, embellishments and/or pockets or slots for holding a driver's license, credit card, currency, cosmetics and the like.

Figure 4:
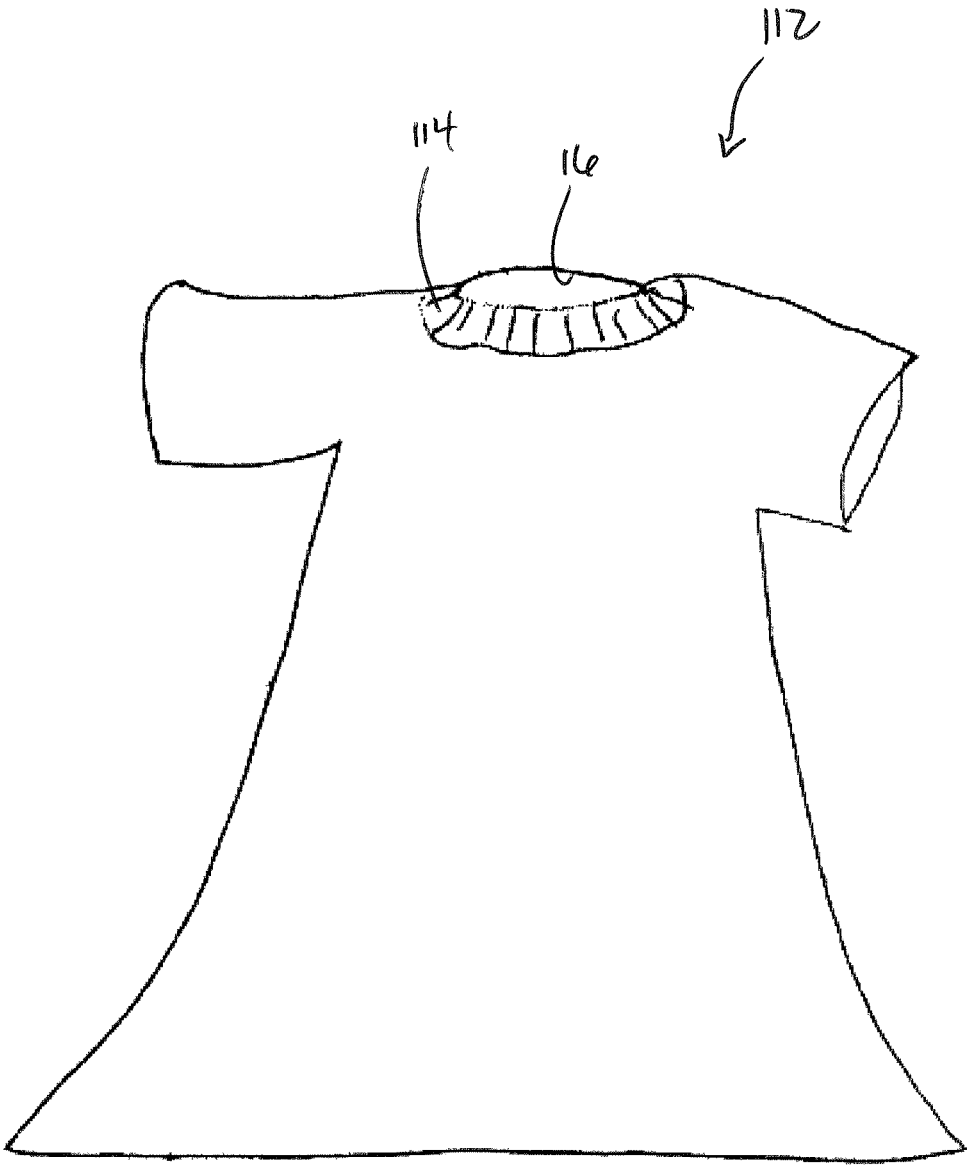
FIG. 4 is a perspective view of a shroud of the apparatus of FIG. 1, according to an embodiment of the present invention.

With reference to FIG. 4, in an embodiment, the shroud 112 may be constructed in the shape of a shirt or athletic jersey (such as a football jersey) which can be printed or embroidered with any desired text or logo (such as the logo of a mascot or sports team). In any of the embodiments described herein, the top opening 16 may define an elastic opening 114 which helps to maintain contact between the opening 16 and the strap that extends therethrough, as well as expand so that it may be coupled to the strap.

Figure 5:
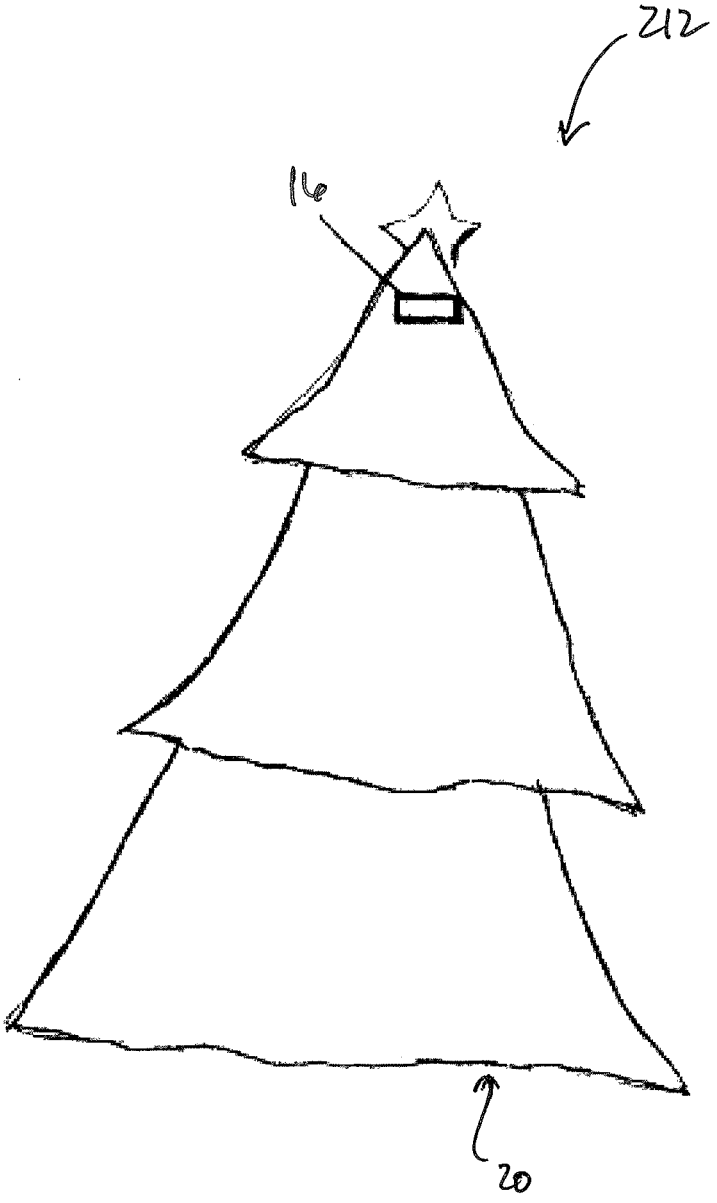
FIG. 5 is a perspective, rear view of a shroud of the apparatus of FIG. 1, according to another embodiment of the present invention.

With reference to FIG. 5, the shroud 212 may be designed to be festive in nature, the shroud 212 taking the form of a Christmas tree. As illustrated therein, in any embodiment, the opening 16 for the strap 22 may be formed in a posterior side of the shroud 212 providing for an even more pleasing appearance. For example, the entire front of the shroud 212 may be uninterrupted by the strap 22 (and the strap may be at least partially hidden behind the shroud 212).

Figure 6:
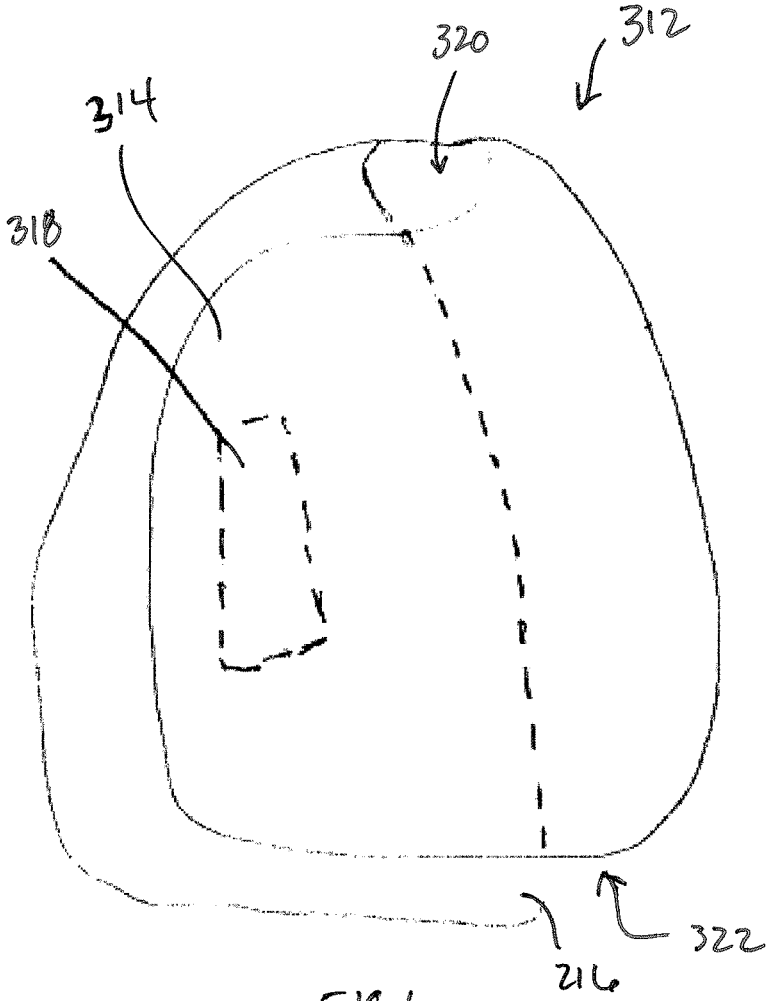
FIG. 6 is a perspective view of a shroud of the apparatus of FIG. 1, according to yet another embodiment of the present invention.
Figure 7:
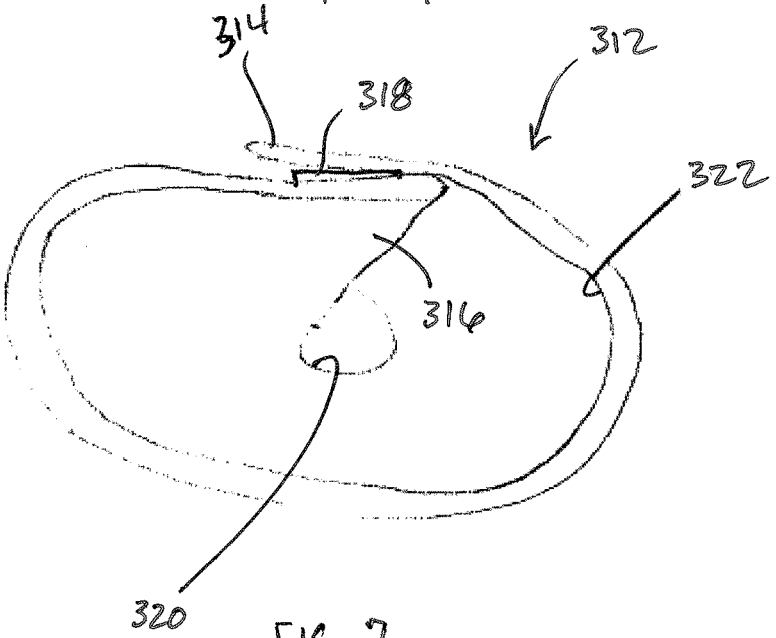
FIG. 7 is a bottom plan view of the shroud of FIG. 6.

Turning now to FIGS. 6 and 7, an alternative construction for a shroud 312 for the apparatus 10 is illustrated, whereby the shroud 312 can be removed or detached from the strap 22. As shown therein, the shroud 312 may be formed from a wrappable length of material having a first end 314 and a second end 316. At least one of the first end 314 and the second end 316 has a fastening patch 318 formed from Velcro or other type of adhesive material that enables the first end 314 to be secured to the second end 316. In use, the material is wrapped around the strap 22 of the apparatus 10 and secured utilizing fastening patch 318 to define the shroud 312 and forming top opening 320 and bottom opening 322. In embodiments where the shroud is detachable from the strap, the shroud may be attached to any existing lanyard or existing strap and retaining mechanism.

Figure 8:
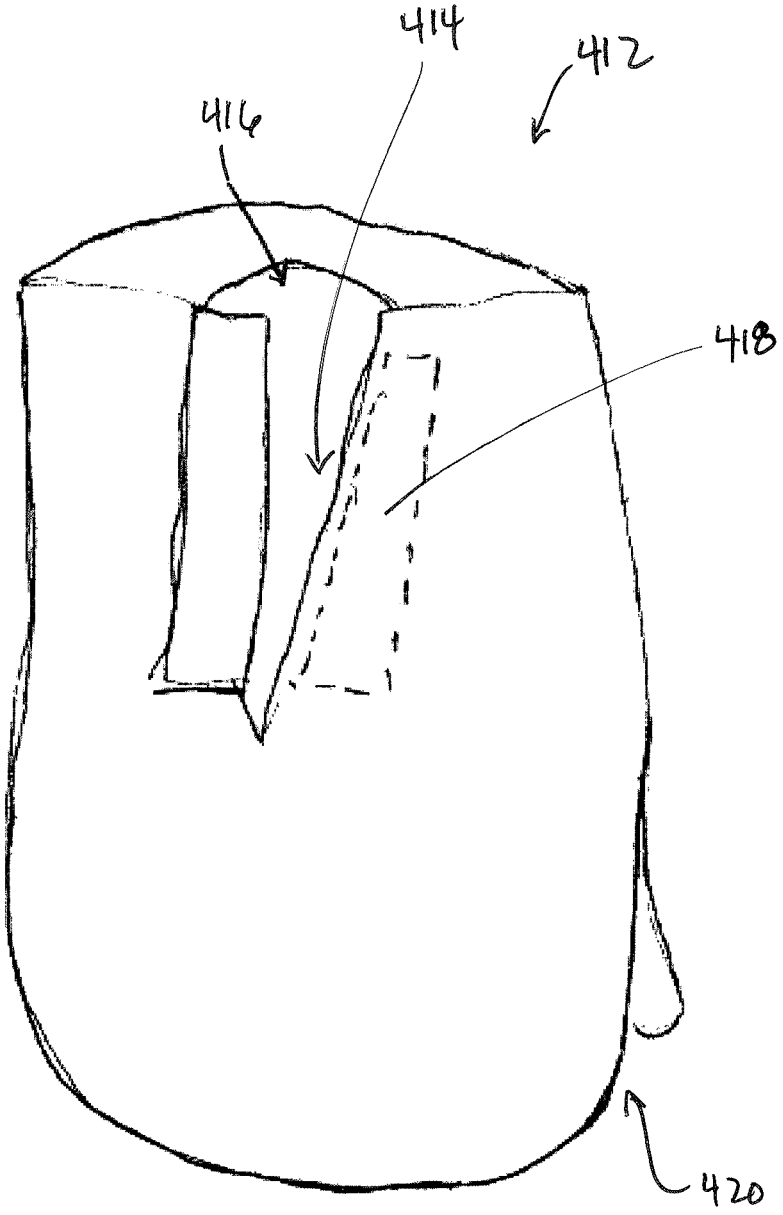
FIG. 8 is a perspective view of a shroud of the apparatus of FIG. 1, according to yet another embodiment of the present invention.

Turning now to FIG. 8, another alternative construction for a shroud 412 for the apparatus 10 is illustrated. As shown therein, the shroud 412 may include a notch 414 or slit associated with the top opening 416 (and opposite bottom opening 420). One side of the notch 414 may include a fastening area 418 containing Velcro or an adhesive for selectively closing the notch 414 to secure the shroud 412 to the strap 22. Importantly, the notch 414 provides greater clearance for coupling the shroud 412 to the corresponding strap 22. In use the keys and other objects may first be coupled to the object retaining mechanism on the end of the strap 22, and the shroud 412 then coupled to the strap 22 and slid down over the keys and objects to be secured and protected. The bigger opening afforded by the notch 414 enables easier attachment of the shroud 412 to the strap 22.

Figure 9:
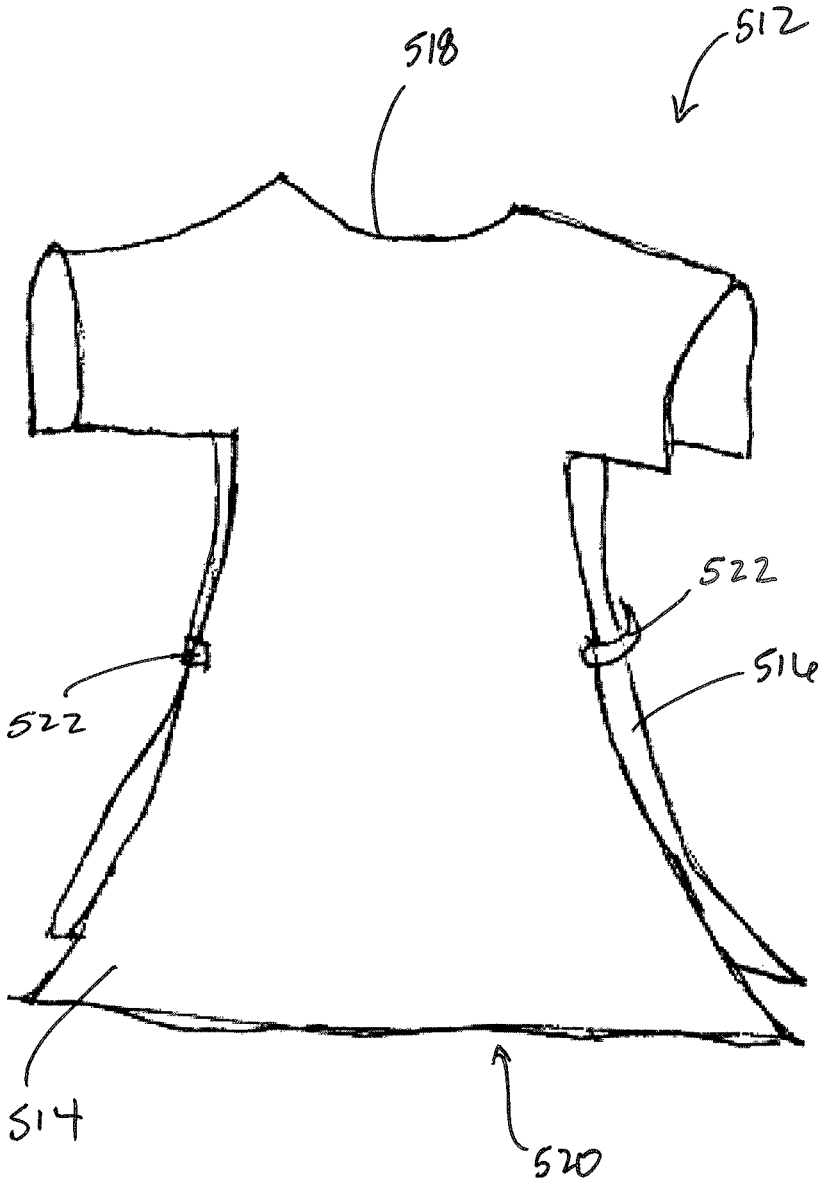
FIGS. 9 and 10 are perspective views of a shroud of the apparatus of FIG. 1, according to yet another embodiment of the present invention.
Figure 10:
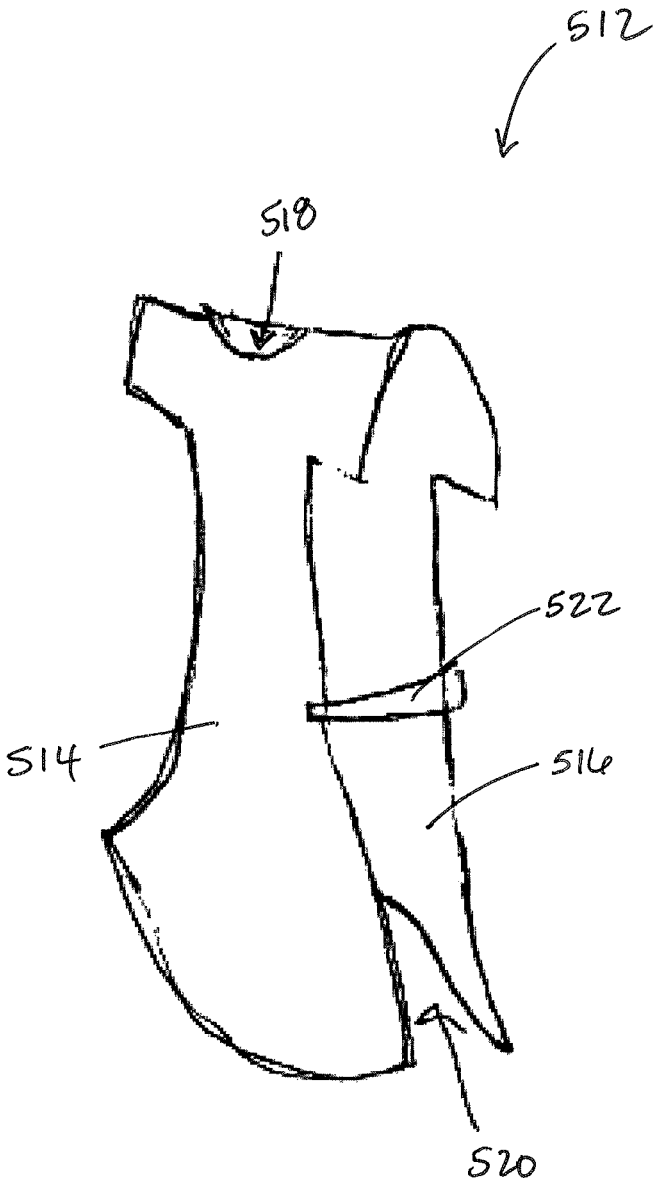

Referring final to FIGS. 9 and 10, yet another alternative construction for a shroud 512 for the apparatus 10 is shown. As illustrated therein, the shroud 512 is formed from opposed pieces of material that can be folded in half to define front and back faces 514, 516 of the shroud 512, respectively. As with shroud 12, the shroud 512 includes top and bottom openings 518, 520, respectively. A strap or tether 522 connects the front and back faces 514, 516 to one another, preventing separation. In an embodiment, the tether may be formed form an elastic material.

Figure 11:
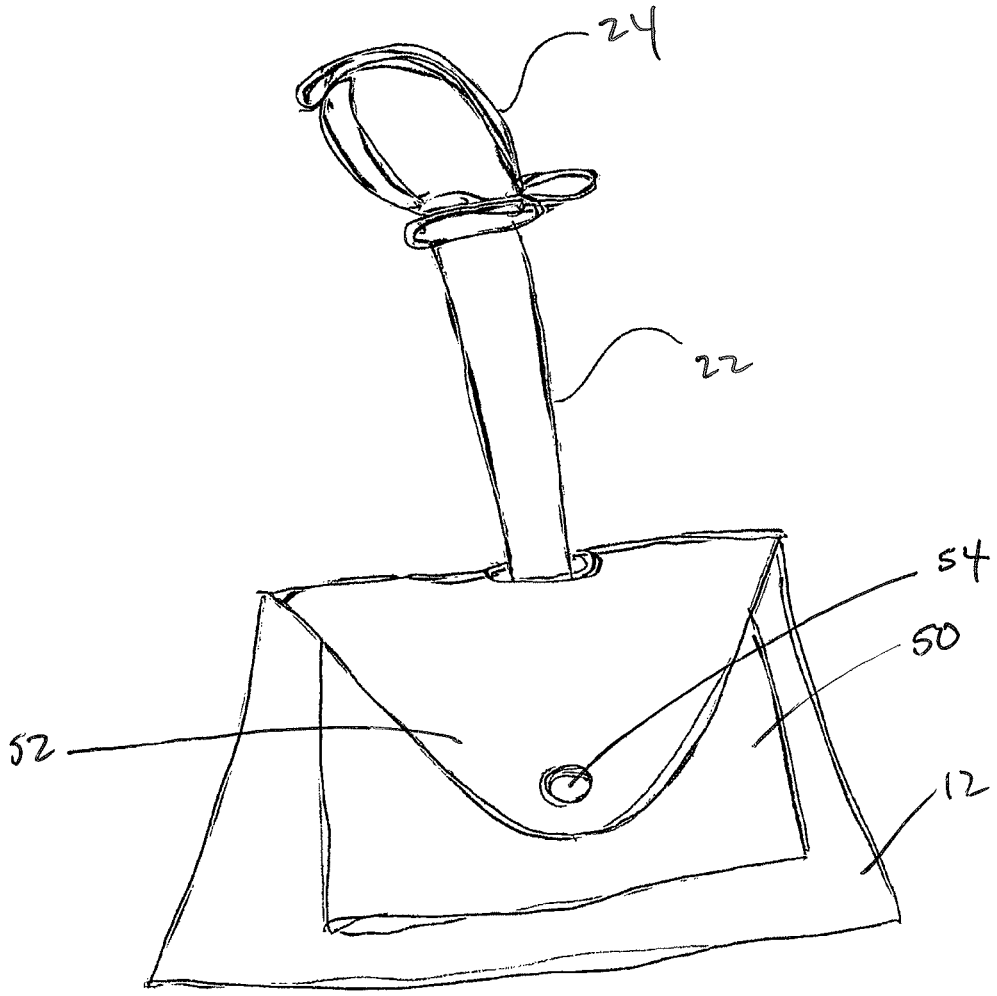
FIGS. 11 and 12 are perspective views of a shroud having a closeable pocket according to an embodiment of the present invention.
Figure 12:
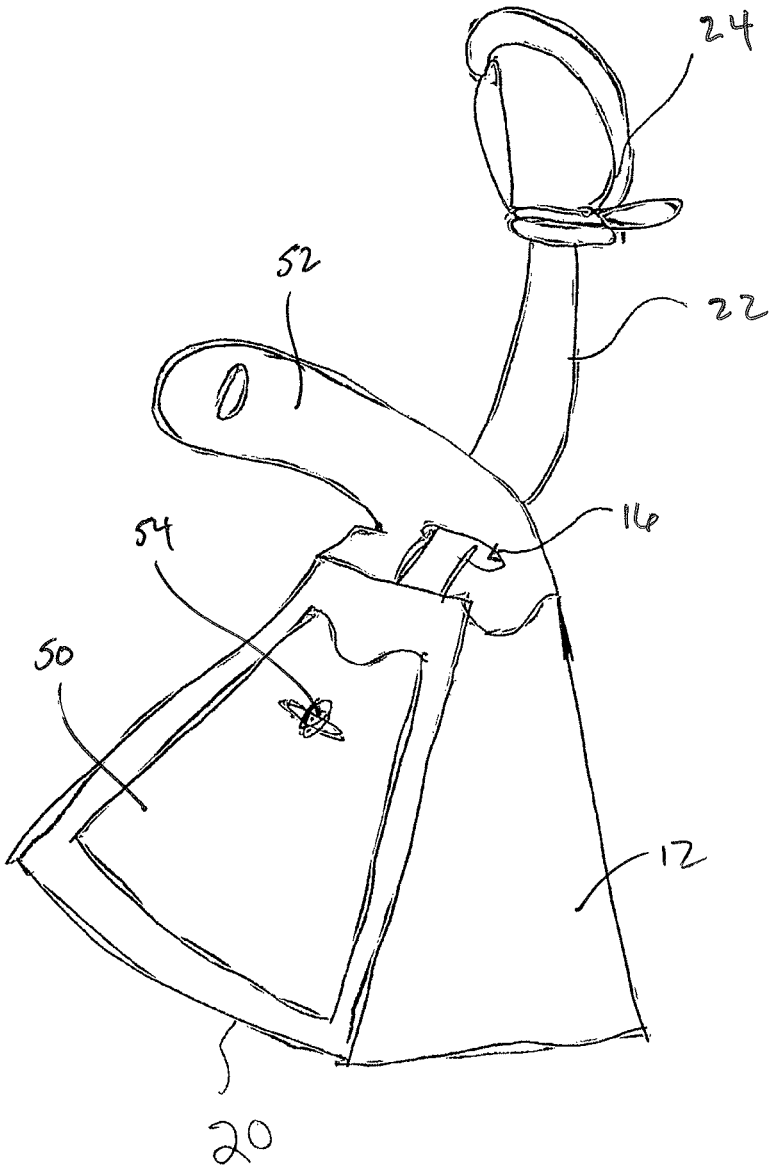

As alluded to above, and in connection with FIGS. 11-15, the device of the present invention may include various pouches and other accessories that provide for an even greater level of convenience and ease of use. For example, as illustrated in FIGS. 11 and 12, the shroud (shown as shroud 12, but which can be configured according to any of the embodiments described herein) may include a pocket 50 or slot on one or more sides of the shroud 12 for storing credit cards, identification or the like. In an embodiment, the pocket 50 can be sized and shaped to receive a mobile phone. In yet other embodiments, the pocket 50 may be formed as a holster or clip for a mobile phone. As shown in FIGS. 11 and 12, the shroud 12 may also include a flap 52 that is configured to cover the opening in the pocket 50 to securely stow an item placed therein, as well as a snap 54, button or like fastener for holding the flap 52 in place over the pocket 50.

Figure 13:
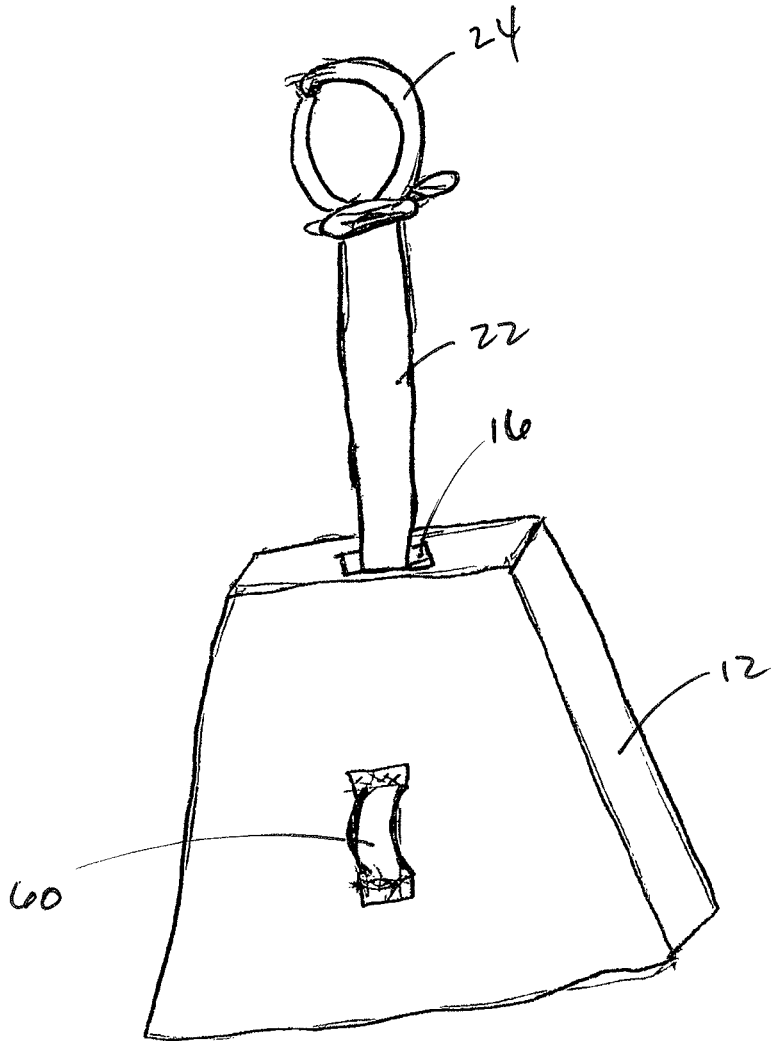
FIGS. 13 and 14 are perspective views of a shroud having a loop for facilitating attachment to a wearer, according to an embodiment of the present invention.
Figure 14:
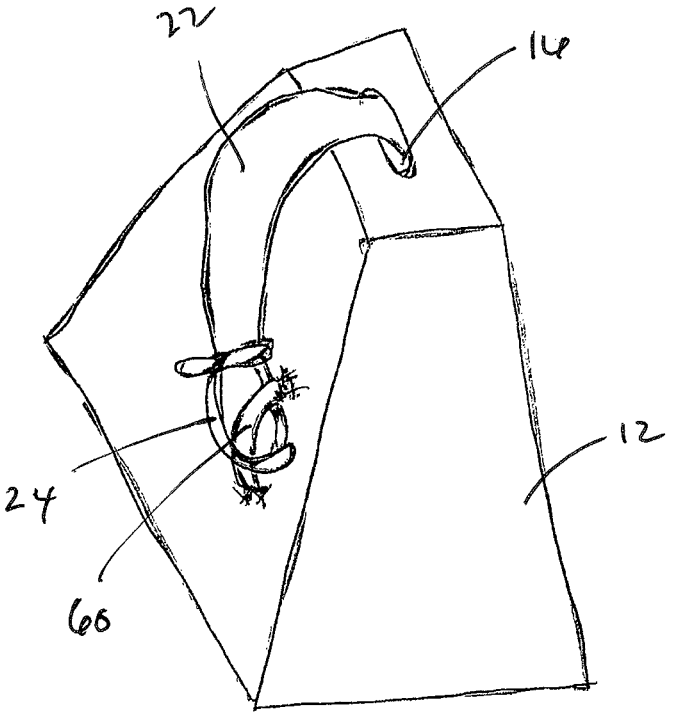

With reference to FIGS. 13 and 14, in an embodiment, one side of the shroud 12 may include a loop 60 which enables the device 10 to be attached to a wearer's belt loop or the like (rather than to a purse). Importantly, the strap 22 can be placed through a wearer's belt loop and then the clasp fastened to the loop 60, as best shown in FIG. 14. This effectively shortens the strap and retains the device close to a wearer's body, thereby minimizing the swinging motion of the device while walking.

Figure 15:
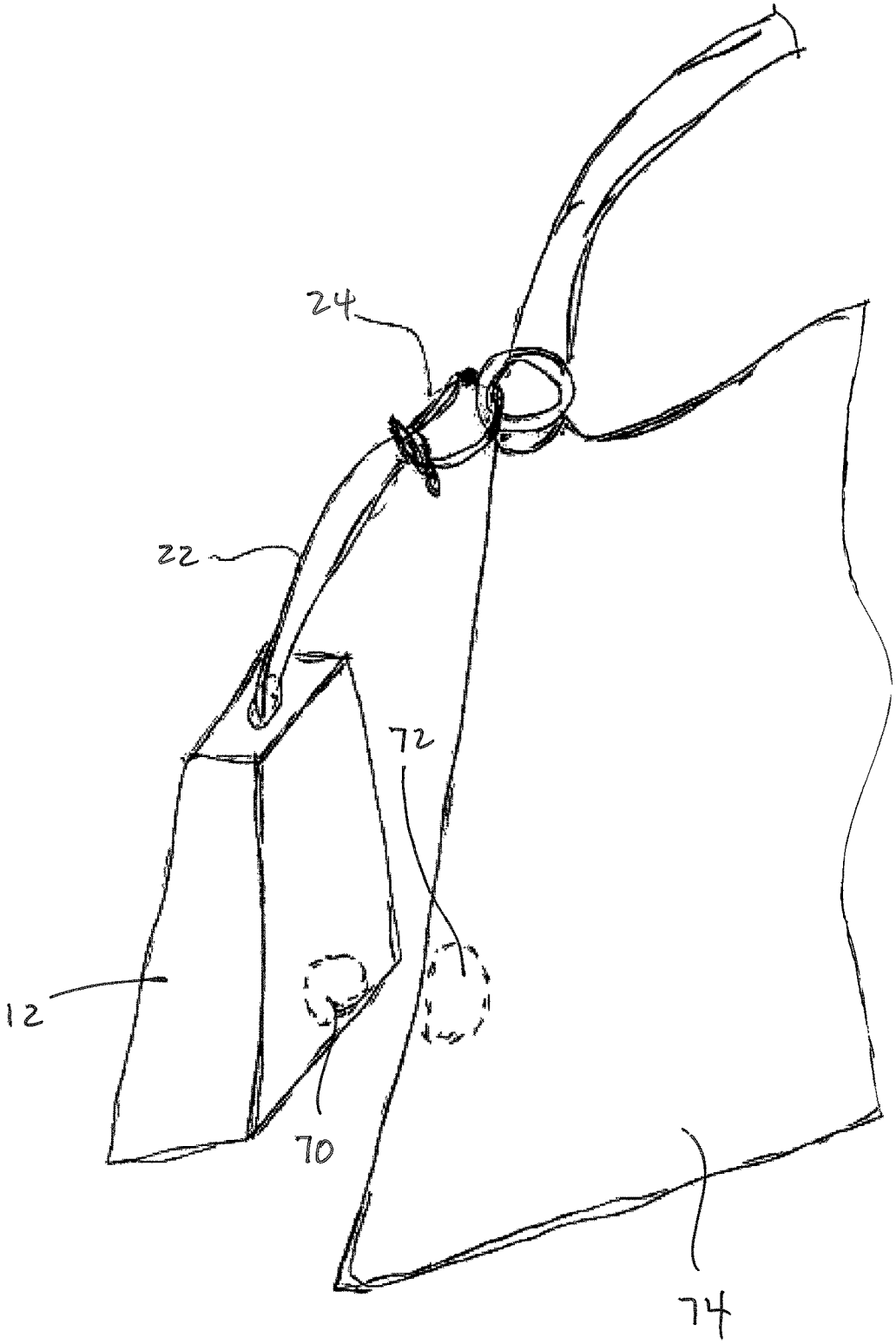
FIG. 15 is a perspective view of a shroud having a means of attachment for connecting to a purse or other accessory, according to an embodiment of the present invention.

Lastly, as shown in FIG. 15, in certain embodiments a magnet 70 may be integrated into one or more sides of the shroud 12, which is configured to mate with a corresponding magnet 72 integrated into a purse 74 (or briefcase, laptop bag or other accessory). This enables the body of the shroud 12 to be releasably connected to the purse 74, preventing it from swinging during movement. While shown as magnets, other means for a releasable connection such as Velcro, snaps and the like may also be utilized to provide a breakable or releasable connection between the body of the shroud and a purse or other accessory.

Importantly, the apparatus of the present invention provides a means for securing and protecting keys and other small objects in a convenient manner, ensuring that such keys and objects are readily and easily accessible to a user, when needed. In particular, the shroud of the apparatus provides protection from inclement weather, and prevents the keys and objects stowed therein from rubbing up against other materials. As will be readily appreciated, by providing an apparatus that is configured to be secured to the exterior of a purse, handbag, backpack, briefcase or the like, typical misplacement of keys and other objects coupled thereto can therefore be eliminated. In connection with this, the apparatus of the present invention keeps desired items close at hand, eliminating the need to retrieve such items out of pockets, handbags or other enclosed areas that may contain a variety of other items.

Moreover, the apparatus of the present invention eliminates the need for prying keys and other hanging items from their containers, which may be the case with existing devices, and is configured to accommodate key ring items of various shapes. As discussed in detail above, the shroud can be constructed to in any shape, form and may contain any desired design, enabling the apparatus to simultaneously function as a decorative accessory.

In addition to the above, where an elastic or extendable cord is utilized, extended reach is provided, rendering it easier to use the keys to unlock doors (and other objects for their respective intended uses) without decoupling of such objects from the apparatus or the purse, handbag or the like to which the apparatus is attached.

While the apparatus has been described herein as proving a protective cover for keys, key fobs and the like, it is contemplated that the apparatus may secure and protect any small object including, but not limited to, remotes, charms, membership tags, nail files, retractable cords, mouth guards (and mouth guard cases). Moreover, the apparatus may be attached to any desired personal accessory including, but not limited to, brief cases, laptop cases, articles of clothing and luggage.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of this disclosure.

What is claimed is:

1. An apparatus for securing and protecting small objects, comprising:

a shroud having a top opening and a bottom opening, the bottom opening extending substantially an entire width and depth of the shroud;

a pocket on an outer surface of the shroud;

a flap that is selectively closeable over an opening of the pocket to secure the pocket, the flap including an aperture;

a strap received through the top opening of the shroud and through the aperture in the flap, and having a first end and a second end;

a clasp on the first end of the strap, the clasp being selectively openable and closeable to allow the clasp to be attached directly to a wearable article of a user; and an object retaining mechanism on the second end of the strap for receiving an object;

wherein the shroud is slidable along the strap between a stowed position, where the shroud substantially covers the object, and an access position, where the object is positioned outside the shroud permitting access to the object.

2. The apparatus of claim 1, wherein:

the shroud has a generally tapered shape.

3. The apparatus of claim 1, wherein:

the object is at least one of a key and a mouth guard.

4. The apparatus of claim 1, wherein:

the shroud includes a magnet for releasably engaging a corresponding magnet on an accessory to which the apparatus is attached;

wherein engagement between the magnets minimizes swinging of the apparatus during movement.

5. The apparatus of claim 1, wherein:

the top opening includes an elastic member defining the top opening.

6. The apparatus of claim 1, wherein:

the clasp is one of a swivel lobster-claw clasp.

7. The apparatus of claim 1, further comprising:

a fastening member for retaining said flap in a closed position over said opening of said pocket.

8. An apparatus for securing and protecting keys and other objects, comprising:

a shroud having a top opening adjacent to one end and a bottom opening adjacent to another end opposite the top end, the bottom opening extending substantially an entire width and depth of the shroud;

a pocket on an outer surface of the shroud;

a flap that is selectively closeable over an opening of the pocket to secure the pocket, the flap including an aperture;

a strap receivable through the top opening of the shroud and through the aperture in the flap, the strap having opposed first and second ends, the first end having a clasp configured for coupling to a personal accessory and the second end being configured for coupling to at least one object;

wherein the shroud is slidable along the strap between a stowed position, where the shroud substantially houses the at least one object coupled to the second end of the strap, and an access position, where the shroud is located along the strap at a position where the at least one object coupled to the second end of the strap is exposed from the shroud;

wherein the clasp is selectively openable and closeable to allow the clasp to be attached directly to the personal accessory; and wherein a length of the strap is selectively extendable.

9. The apparatus of claim 8, further comprising:

a retaining member attached to the second end of the strap for receiving the at least one object.

10. The apparatus of claim 8, wherein:

the at least one object is one of a key, key fob, mouth guard, nail file, charm, and remote.

11. A method for securing and protecting keys and other objects, comprising the step of:

attaching at least one object to a first end of a strap;

coupling the strap to a shroud such that the strap is slidably received through an aperture in a top of the shroud and through an aperture in a flap that is selectively closeable over an opening of a pocket on an outer surface of the shroud; and attaching a clasp on a second end of the strap to a personal accessory, including opening the clasp, directly coupling the clasp to the personal accessory, and closing the clasp;

wherein the shroud is movable towards the first end of the strap to receive the object through a bottom opening in the shroud that extends substantially an entire width and depth of the shroud, and to enclose the at least one object within the shroud; and wherein the shroud is movable towards the second end of the strap to expose the at least one object.

12. The method according to claim 11, wherein:

the strap is an elastic strap, wherein when the at least one object is exposed from the shroud and the object is released, the elastic strap functions to automatically retract the at least one object into the shroud.

* * * * *